United States Patent [19]

Harvey

[11] 4,035,967

[45] July 19, 1977

[54] RAISED FLOOR PANELS

[75] Inventor: Ronald William Stanley Harvey, Welwyn, England

[73] Assignee: A. R. I. Propaflor Limited, United Kingdom

[21] Appl. No.: 426,057

[22] Filed: Dec. 19, 1973

[30] Foreign Application Priority Data

| | | |
|---|---|---|
| Dec. 22, 1972 | United Kingdom | 59463/72 |
| June 28, 1973 | Germany | 2333005 |

[51] Int. Cl.[2] ..... E04F 15/024

[52] U.S. Cl. ..... 52/126; 52/263; 52/622

[58] Field of Search ..... 248/354 S; 52/126, 619, 52/623, 620, 622, 263, 510

[56] References Cited

U.S. PATENT DOCUMENTS

| | | | |
|---|---|---|---|
| 2,542,860 | 2/1951 | Clements | 52/623 |
| 2,830,332 | 4/1958 | Pawlowski | 52/126 |
| 2,867,301 | 1/1959 | Benton | 52/263 |
| 2,912,725 | 11/1959 | Ries | 52/619 X |
| 3,065,506 | 11/1962 | Tremer | 52/126 |
| 3,443,349 | 5/1969 | Mahle | 52/623 X |
| 3,548,559 | 12/1970 | Levine | 52/619 |
| 3,616,584 | 11/1971 | Sartori et al. | 52/126 |
| 3,689,017 | 9/1972 | Harvey | 52/301 |
| 3,696,578 | 10/1972 | Swensen et al. | 52/126 X |
| 3,759,005 | 9/1973 | Smith | 52/623 X |

*Primary Examiner*—Leslie Braun
*Attorney, Agent, or Firm*—Rose & Edell

[57] ABSTRACT

The invention relates to raised flooring panels which have excellent fire resistance. The panels of the invention comprise wooden panels whose undersides and side edges are covered with a metal sheet, and the panels being strengthened by downwardly projecting metal flanges. Such a panel can have better fire resisting properties than a metal panel which is liable to warp when there is a fire and which conducts heat to its upper surface so that floor coverings rapidly reach their flash point or than a wooden panel whose underside but not side edges are covered with a metal sheet.

4 Claims, 3 Drawing Figures

RAISED FLOOR PANELS

This invention relates to panels for raised flooring and more particularly to panels provided with fire-resisting means so that they have excellent fire resistance.

BACKGROUND OF THE INVENTION

Raised floors made up of panels of rectangular or square shape supported at their corners by props are often suitable for computor buildings, telephone exchanges and the like, since the large number of electrical cables leading to and from the apparatus can be conveniently accommodated in the under floor space. In order to provide adequate fire protection in these buildings the raised floors must be capable of preventing fires which start in the under floor space from spreading to the space above the floor for as long as possible.

Metal floor panels are of course non-combustible but the disadvantage of using these is that due to their high heat conductivity floor coverings quickly reach their flash point thus allowing fire to spread above the raised flooring. They also have the disadvantage that in the event of fire they quickly warp.

Wooden floor panels having their undersides covered with fire resistant metal are not particularly effective since fire can still travel up the narrow gaps between adjacent panels thus allowing fire to spread along the vertical edges of the panels to the top of the floor.

The invention has been made with these points in mind and an object of the invention is to provide a flooring panel for raised floors which will substantially avoid the above mentioned disadvantages.

THE INVENTION

According to the invention there is provided a flooring panel for raised flooring comprising a wooden panel covered on its underside and sides with fire-resisting metal, and strengthened by downwardly projecting metal flanges.

The panel according to the invention has the advantage that in the event of fire, not only is the wooden panel protected by the metal covering, but that due to the low heat conductivity of the wooden panel the problems of heat conduction and warping which exist with completely metal flooring panels are avoided. Furthermore, fires which start in the underfloor space cannot spread to the above-floor space since the underside of the panel and the sides of the panel are protected by the fire resisting metal covering.

The wooden panel can be of one or more planks of solid wood but is preferably made from wood composition sheets such as, for example, chipboard, blockboard, or plywood.

The floor panel can be provided with the usual coverings to improve appearance including plastics coverings, tiles, carpeting and the like.

Preferably, the downwardly projecting metal flanges are arranged to form a continuous flange around the edge of the flooring panel such that the flange at the corners of the flooring panel can interengage the upper ends of upright floor props. Suitable floor props which can be used with the flooring panel of the invention are those described in U.K. Pat. Specification No. 1,102,373 and U.S. Pat. No. 3,689,017.

In one embodiment of the invention the fire-resisting metal covering the underside and sides of the wooden panel is in the form of metal foil, and the downwardly projecting flanges are angle section bars mitred at the corners to provide a continuous flange around the side edges of the panel.

However, in a preferred embodiment of the invention the downwardly projecting metal flanges are formed integrally with the fire-resisting metal covering the underside and sides of the panel. Thus, the metal covering the underside and sides of the wooden panel and the metal flanges can be formed from a single sheet of metal after being suitably cut and bent.

Thus according to another aspect of the invention there is provided a metal sheet capable of being bent and attached to a wooden panel to form a flooring panel for a raised flooring, characterised by a rectangular or square section and four leaves which are formed integrally with and extend from the edges of the rectangular or square section, each leaf comprising a first sub-section adjacent the square or rectangular section and capable of being bent downwards to form one side of a downwardly projecting metal flange and a second sub-section adjacent the first sub-section and capable of being bent upwardly and back onto the first sub-section to form the opposite side of the downwardly projecting metal flange, the second sub-section when bent continuing upwardly and in the same plane as the second sub-section to form a cover for the side of a wooden panel, the part of the second sub-section to cover the side of the wooden panel being of sufficient length to extend substantially the whole thickness of the wooden panel.

The part of the second sub-section covering the side of the wooden panel will have a slightly greater length than the first sub-section and the ends of that part will extend beyond the ends of the first sub-section by an amount equal to the thickness of the metal. The part of the second sub-section forming the opposite side of the downwardly projecting flange may also be the same length as the second sub-section covering the sides of the wooden panel.

After bending to suit the wooden panel the top of the metal sheet covering the sides of the wooden panel is often found to be slightly irregular, and thus it is preferable to provide a continuous lipping strip covering the edge which can also be shaped to provide a continuous edging strip around the panel to fill any small crevices between adjacent panels when in their errected position.

Optionally, the fire-resisting metal provided on the underside of the wooden panel can be separated from the panel by a sheet of asbestos or other heat insulating material to provide increased resistance to fire.

BRIEF DESCRIPTION OF THE DRAWINGS

The invention will now be illustrated with reference to the accompanying drawings, in which.

DESCRIPTION OF THE PREFERRED EMBODIMENTS

A floor panel 10 according to the invention comprises a wooden panel 12 composed of, for example, chipboard, blockboard, plywood or timber. The panel 10 may be of any convenient size such as for example two feet square.

Figure 3:
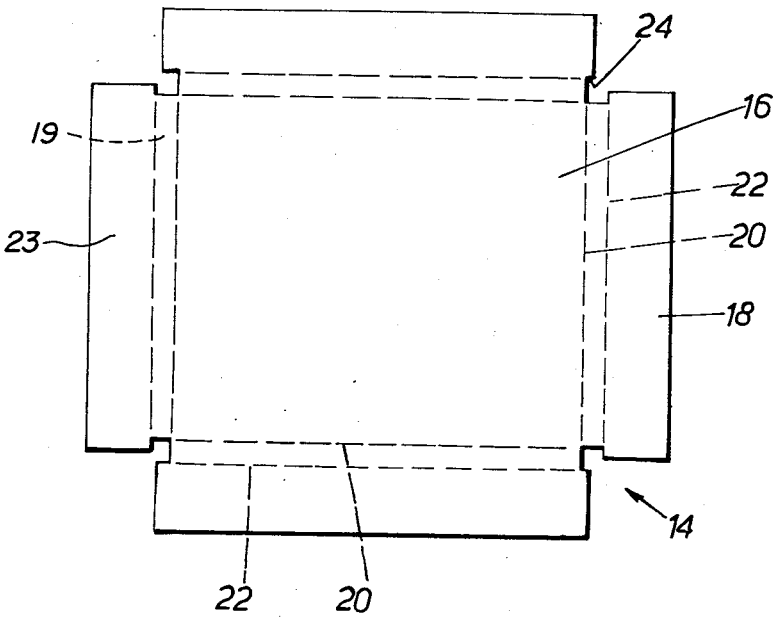
FIG. 3 is a plan view showing a metal sheet which can be shaped to form part of the panel according to the invention.

A metal sheet 14 which may be, for example, 18 or 19 gauge steel is formed having the shape shown in FIG. 3. The sheet 14 comprises a square section 16 to be attached to the underside of the wooden panel 12 and four leaves 18 extending the edges of the square section 16.

Each of the leaves 18 consists of a first sub-section 19 positioned between bend lines shown as dotted lines 20 and 22 and a second sub-section 23.

The sheet 14 is bent downwardly along the inner dotted bend lines 20 and then back outwardly and upwardly on itself along the outer dotted bend line 22 to provide downwardly extending flanges 26, metal sides 28, and the section 16 covering the underside of the wooden panel 12. The wooden panel 12 is is slightly longer and wider than the square section 16 defined by the bending lines 20 and this allows the sub-sections 23 of the metal leaves 18 forming the sides 28 to abut the edges of the wooden panel.

The wooden panel 12 is then placed in and fixed to the shaped panel 12 using a suitable wood-metal adhesive such as an epoxy or phenolic resin.

A lipping and edging strip 34 is then fixed to the upper edge 36 of the sides 28. This lipping strip 34 provides a continuous edging strip around the panel 12 to fill any crevices between adjacent panels when in their errected position.

The upper surface of the flooring panel 10 is then provided with a suitable floor covering such as a floor tile 40.

Figure 1:
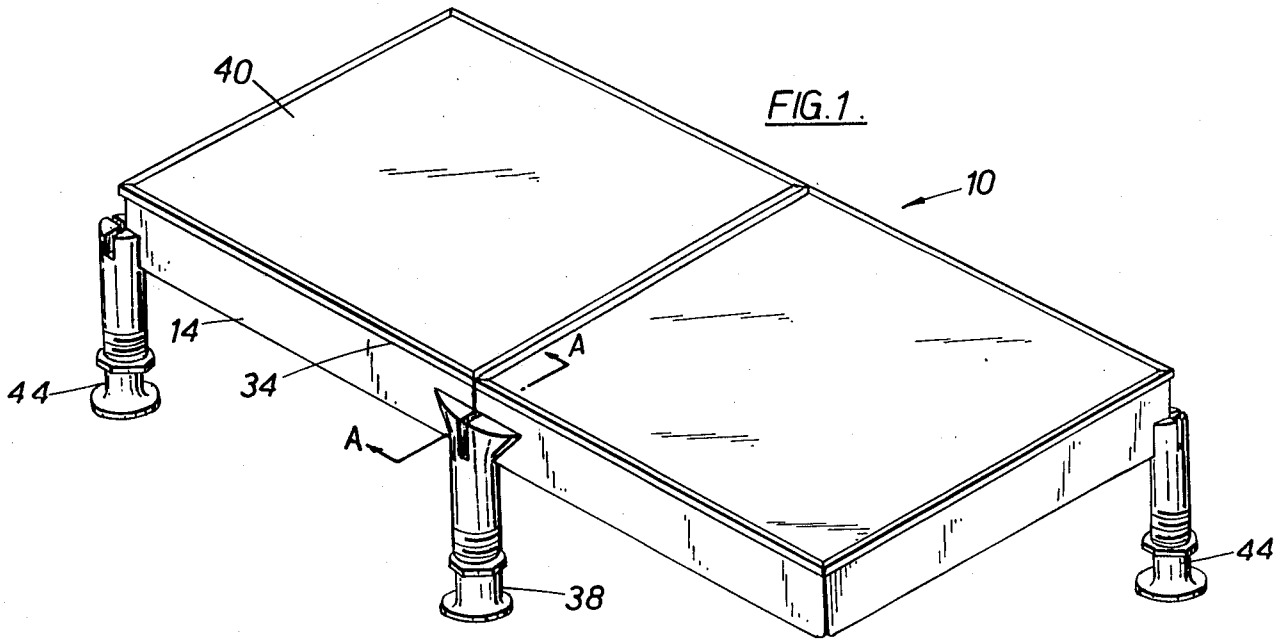
FIG. 1 is a perspective view showing a raised floor incorporating the panels according to the invention.
Figure 2:
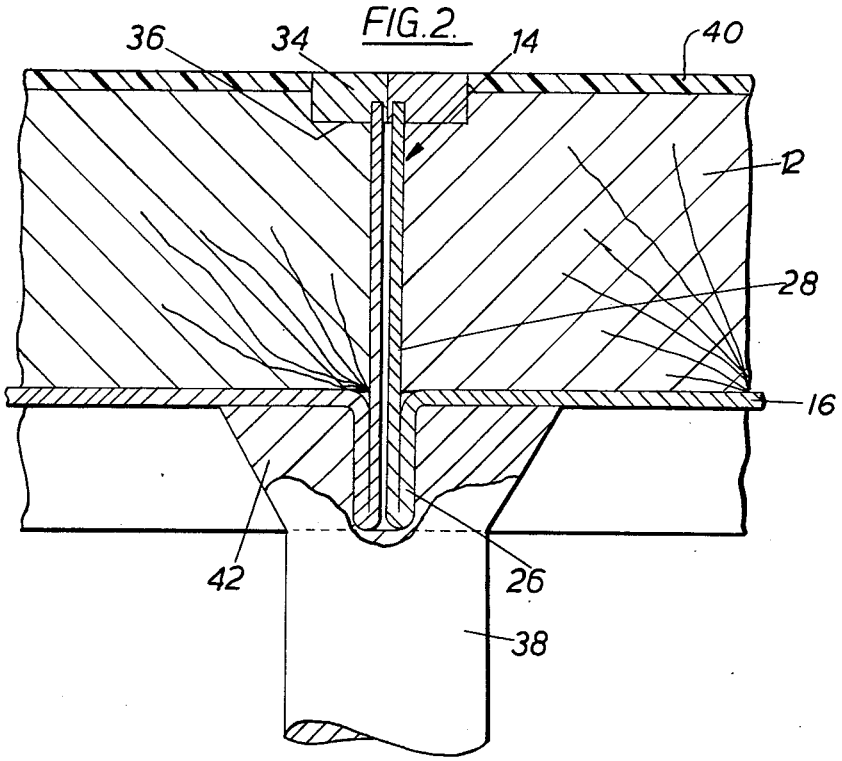
FIG. 2 is a vertical section taken through adjacent abutting corners of four panels.

The panels 10 are then mounted on adjustable props 38, the flanges 26 interengaging slots is cruciform shaped prop heads 42. Instead of the props 38 shown in FIG. 2, props 44 shown in FIG. 1 having a simpler head consisting of a hollow tube with perpendicular grooves can be used.

As a further precaution against fire a layer of asbestos (not shown) can be incorporated between the square section 16 of the metal sheet and the underside of the wooden panel 12.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim

1. A flooring panel for a raised flooring comprising:

a rectangular wooden panel having an upperface, an underface and side edges, a fire-resisting metal pan adhered to and covering said underface and side edges of said wooden panel, said metal pan comprising a shaped metal sheet having a flat rectangular shaped section for covering and contacting substantially all of said underface of said wooden panel, four leafs extending from said edges of said rectangular shaped section, each of said leaves comprising a first sub-section adjacent said rectangular shaped section bent downwardly at right angles from said rectangular shaped section and a second sub-section folded back on said first sub-section to form firstly with said first sub-section a downwardly projecting metal flange and secondly extending upwardly past said first sub-section by substantially the thickness of such wooden panel to form a metal cover for said side edges of said wooden panel.

2. A flooring panel according to claim 1 further comprising an edging strip provided around said side edges of said wooden panel adjacent its upper face to form a seal to fill any crevices between adjacent panels when assembled to form a raised floor.

3. A flooring panel according to claim 1 in which said wooden panel is square and said flat rectangular shaped section of said metal pan is square.

4. A raised flooring composed of flooring panels according to claim 1, and flooring props for engaging said metal flanges to support said flooring panels.

* * * * *